United States Patent [19]

Nakamura et al.

[11] 4,338,902

[45] Jul. 13, 1982

[54] FUEL SUPPLYING DEVICE FOR INTERNAL COMBUSTION ENGINE

[75] Inventors: Hirokazu Nakamura, Kyoto; Bonnosuke Takamiya, Jyoyo; Takao Miki, Himeji; Takashi Ishida, Ooi, all of Japan

[73] Assignees: Mitsubishi Jidosha Kogyo Kabushiki Kaisha; Mitsubishi Denki Kabushiki Kaisha; Mikuni Kogyo Kabushiki Kaisha, all of Tokyo, Japan

[21] Appl. No.: 56,670

[22] Filed: Jul. 11, 1979

[30] Foreign Application Priority Data

Jul. 14, 1978 [JP] Japan ..... 53/86371

[51] Int. Cl.[3] ..... F02D 3/02

[52] U.S. Cl. ..... 123/454; 123/458; 123/461; 251/205

[58] Field of Search ..... 123/452, 453, 454, 455, 123/458, 460, 482, 461, 41.34; 251/205, 122

[56] References Cited

U.S. PATENT DOCUMENTS

| | | | |
|---|---|---|---|
| 3,745,420 | 7/1973 | Hafner | 361/203 |
| 3,796,197 | 3/1974 | Locher | 123/458 |
| 3,796,199 | 3/1974 | Knapp | 123/454 |
| 3,957,930 | 5/1976 | Birmingham | 251/122 |
| 4,003,350 | 1/1977 | Eisele | 123/454 |
| 4,132,195 | 2/1979 | Bianchi | 123/454 |
| 4,195,814 | 4/1980 | Kimata | 251/205 |

*Primary Examiner*—Charles J. Myhre
*Assistant Examiner*—Carl Stuart Miller
*Attorney, Agent, or Firm*—Sughrue, Mion, Zinn, Macpeak & Seas

[57] ABSTRACT

A fuel supplying device for an internal combustion engine having a fuel supply passage (4) for introducing fuel fed from a fuel pump (2) at a substantially constant pressure to a fuel injector (9) operative at a predetermined constant pressure. The fuel injector is installed at a congregated portion (7) of engine intake manifolds (8). A metering valve (11) includes a motor (13) so that drop is maintained substantially constant by a differential regulator (12). The metering valve is disposed in an intermediate portion of the fuel supply passage. Calculating means (15) including a servo signal generator (18) calculates an injection flow amount causing a predetermined air/fuel ratio on the basis of signals of various engine running factors. An operational signal output from the servo signal generating circuit of the calculating means is applied to the drive motor means for driving said metering valve to thereby inject fuel into the intake manifolds.

10 Claims, 7 Drawing Figures

FUEL SUPPLYING DEVICE FOR INTERNAL COMBUSTION ENGINE

BACKGROUND OF THE INVENTION

This invention relates to a fuel supplying device for producing an air/fuel mixture using sucked air for an internal combustion engine. More particularly, it relates to spark ignition type fuel injection engines.

Such a fuel injection engine is different from a conventional negative pressure intake carburetor type. In the former case, since pressurized fuel is actively supplied to an intake system to thereby operate the engine, the amount of fuel supply can be intentionally controlled. As a result, a suitable air/fuel mixture is obtained in compliance with various engine running conditions, and also a stable combustion process of the engine can be readily maintained. The above-described fuel injection engine has excellent characteristics.

However, the fuel supplying device of the fuel injection engine requires a control subsystem for a fuel injection rate. In this regard, the conventional control subsystem is complicated in its construction and costly causing the fuel supplying device to be expensive. In addition, since distribution characteristics of air/fuel mixture of the prior art fuel supplying device is insufficient, and a fuel injection nozzle is provided to each cylinder. Accordingly complexity of the fuel supply device and the attendant cost rise are inevitable. As a result, the provision of the fuel supply device is strictly limited to racing cars or a part of expensive automobiles. At present, the provision thereof has not been applied to general automobiles.

SUMMARY OF THE INVENTION

An object of this invention is to eliminate the above-mentioned disadvantages by providing a novel fuel injection system in which fuel is continuously injected to a congregated portion of intake manifolds and at the same time the construction of the control subsystem for fuel injection rate or amount is simplified by adopting a metering method thereto.

Another object of the invention is to provide a fuel injection system for a fuel injection type internal combustion engine, which is simple in construction, is economical and is excellent in practical performance.

The present invention will be hereinafter described referring to the accompanied drawings.

DETAILED DESCRIPTION OF THE INVENTION

Figure 1:
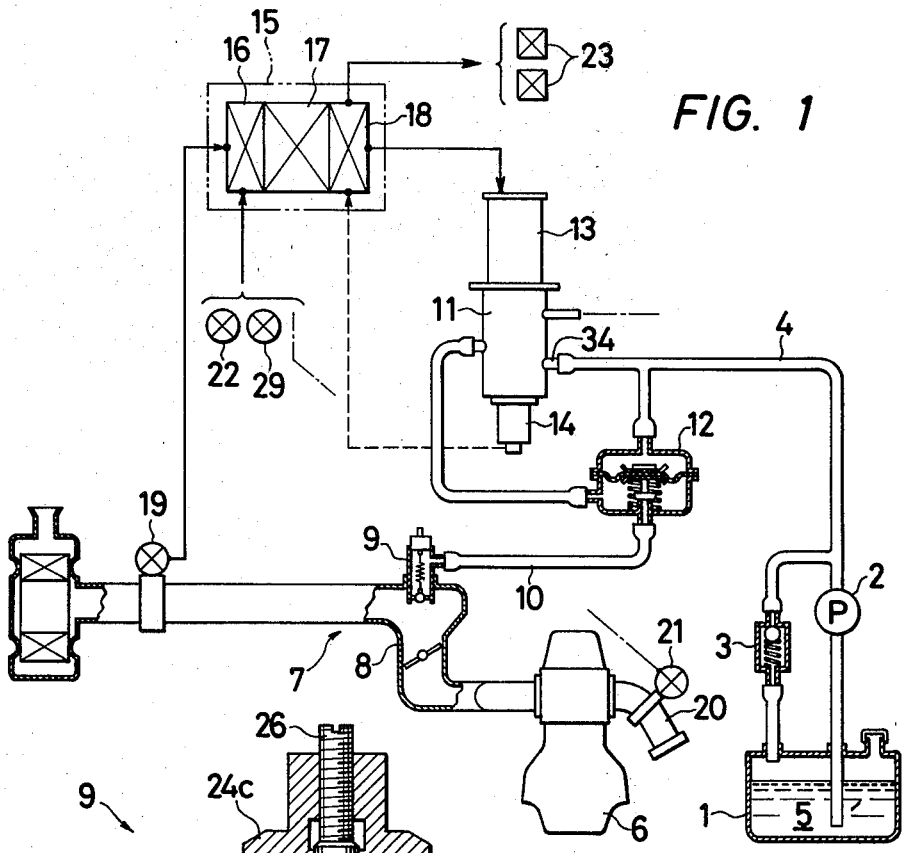
FIG. 1 is a schematic view showing one embodiment of the fuel supply device for use in internal combustion engines according to the present invention.

In one embodiment of a fuel supply device, as shown in FIG. 1, a check valve 3 which is open at a constant pressure is provided between a fuel reservoir 1 and an downstream portion of a fuel pump 2 connected to the fuel reservoir 1. Fuel 5 pressurized at a substantially constant pressure is supplied though a fuel supply passage 4 extending from the fuel pump 2.

A fuel injector 9 (described hereinafter in detail in reference to FIG. 2) is installed at a congregated portion 8 of intake manifolds 7. A spool valve 11 (described hereinafter in detail in reference to FIG. 3) utilized as a metering valve and a differential regulator 12 composed of diaphragm balance or equilibrium pressure chambers are connected in parallel between the above-described passage 4 and a second fuel supply passage 10 connected to the same injector 9. With this construction, a flow pressure decreasing amount of the spool valve 11 is maintained constant, for example at 0.1 $Kg/cm^2$.

Furthermore, an electromagnet type motor 13 for driving the spool valve 11 and an adjust amount sensor 14 for electrically detecting a stroke amount of the spool valve 11 are provided into an integral form concentrically or coaxially to the center axis of the spool valve 11 in the up and down directions thereof, respectively. The motor 13 and the sensor 14 are both electrically connected to controlling or calculating subsystem 15.

The control subsystem 15 comprises three circuits 16, 17 and 18, that is, a factor signal input circuit 16 to which detected signals of engine running factors such as an intake air flow amount is electrically applied, a calculating circuit 17 for calculating or computing an amount of the fuel injection corresponding to an exact air/fuel ratio, and a servo signal generating circuit 18 which supplies the motor 13 etc. with adjust amount operation signals. An output signal of an air flow sensor 19 mounted on an intake manifold 7 is input into the input circuit 16. Also, a signal of an oxygen component amount sensed by an exhaust emission component sensor 21 mounted on an exhaust passage 20 and an output signal produced by a sensor 22 for detecting a rotational speed (which is simply referred to as a number of rotations) of an engine 6 are provided as inputs to the input circuit 16. Furthermore, output signals produced by a factor sensor 29 for detecting an engine temperature, an operational degree of a throttle valve and the like are, when required, inputs into the input circuit 16.

Next, a predetermined calculating method (described hereinafter) corresponding to various engine running conditions is established in the calculating circuit 17. After completion of calculations in compliance with the signals from input circuit 16, the calculating circuit 17 drives the output signal producing circuit 18. This aspect of FIG. 1 system is well known in the art and forms no specific part of the invention except as one component of the system. The specific aspects of the control subsystem 15 are not crucial so long as it can carry out the operations as set forth herein.

Finally, an operational signal produced in the output signal producing circuit 18 is applied to the motor 13 and is, when required, utilized to an exhaust gas recirculation (EGR) device for the engine or actuating devices 23 of an ignition timing advance device or the like. To exactly adjust and actuate the spool valve 11, the output signal of the adjust sensor 14 is fed back to the output signal producing circuit 18 compensating for the above-described operational signal.

Figure 2:
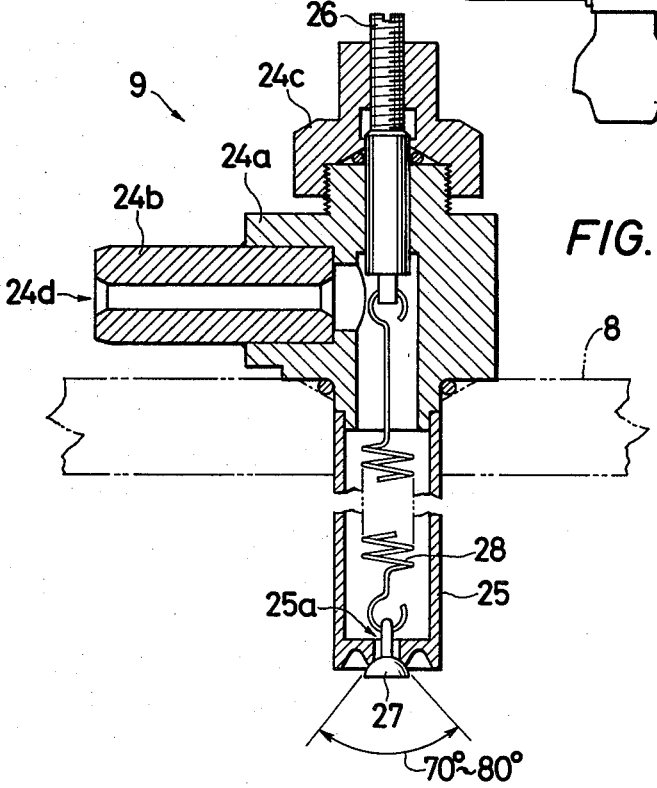
FIG. 2 is an enlarged cross sectional view of the injector shown in FIG. 1.

A complete construction and operation of each of the mechanical parts will now be described. FIG. 2 shows the injector 9 which is composed of body members 24*a*, 24*b* and 23*c* and a nozzle member 25 integral with the body members. An adjust screw 26 is threadedly engaged into the body member 24*c*. A valve 27 abuts against a lower valve seat surface of a jet 25*a* and a tension spring 28 urges the valve 27 to move toward the lower end of the screw 26.

Fuel introduced into the nozzle member 25 from an opening 24*d* communicating with the fuel supply passage 10 can, when at a normal pressure, that is, at the flowing pressure of the spool valve (for example, 2.5 $Kg/cm^2$), overcome the spring pressure of the spring 28 to pressingly lower the valve 27. As a result, the fuel is injected in the diffusion direction having an angle 70° to 80° to the congregated portion 8 of the intake manifolds.

Figure 3:
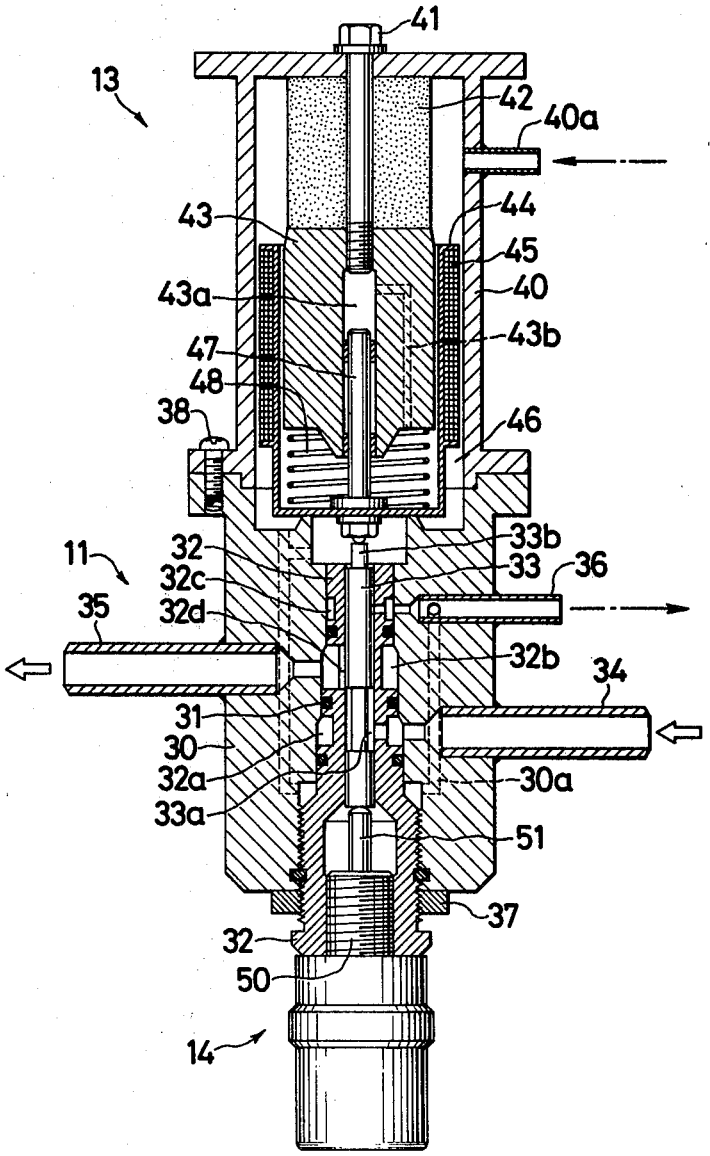
FIG. 3 is an enlarged cross sectional view of the motor shown in FIG. 1.
Figure 4:
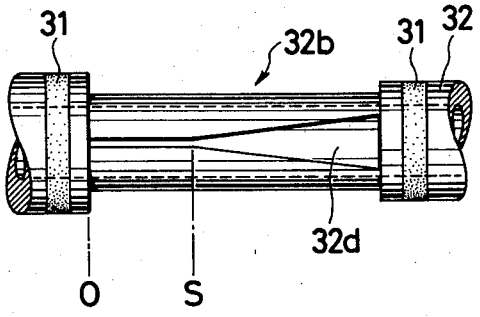
FIG. 4 is a partial side view of the sleeve.

Next, the spool valve 11 is, as shown in FIG. 3, fixedly inserted into an inner cylindrical hole of a body 30 and is composed of a sleeve 32 which is sealed by O-rings 31 and a reciprocative spool 33 whose lands are inserted into the sleeve 32. An annular groove 32*a* communicates with a fuel supply pipe 34, an annular groove 32*b* communicable with a fuel discharge pipe 35 and an annular groove 32*c* communicating with an inner hole of a negative pressure pipe 36 are formed in outer peripheral portion of the sleeve 33. The annular grooves 32*a* and 32*c* communicate with the inner hole of the sleeve through suitable positions and at the same time, the annular groove 32*b* is, as shown in FIG. 4, opened to an adjustable flow passage 32*d*.

The adjustable flow passage 32*d* is configured so that a width thereof is varied along the center axis thereof. Specifically, referring to FIG. 4, the flow passage 32*d* is formed into a slit-like groove on the left side thereof (on the lower side of FIG. 4) while being formed into a triangular groove to increase the width on the right side.

In this case, the sleeve 32 is fixedly secured to the body 30 by the fastening nut 37. A fuel passage 33*a* is defined by the outer periphery of the small diameter portion between the lands of the spool 33. One end of the spool 33 is provided with a projection 33*b*.

A gas and/or liquid passage 30*a* which serves as a cooling passage from the ambient air and in addition as a discharge passage for an internal leaked fuel is formed in the body 30. The passage 30*a* communicates at one end to an end surface on the motor 13 side, at an intermediate portion to one portion of the outer periphery of the sleeve 32 and at the other end of the inner hole of the negative pressure pipe 36 which is connected to a suitable portion of the intake system.

The motor 13 for driving the spool 33 will now be described in detail. The motor 13 as shown in FIG. 3 is composed of a cylindrical housing 40 opened at the lower end, a fixed magnet 42 and an iron core 43 both fixedly secured to an inner upper surface of the housing 40 by the fastening bolt 41, and a movable coil assembly 46 assembled of a core 44 and a coil 45 and provided in an outer gap of the iron core 43. A longitudinal axial rod 47 mounted in an axial direction of the iron core 43 is inserted into a guide hole 43*a* formed on the axis of the iron core 43 and is maintained therein so that the movable coil assembly 46 is prevented from vibrating around the axis.

A lower flanged portion of the motor 13 is fixedly coupled to a flanged portion of the spool valve body 30 by a fastening bolt 38 so that the motor 13 is connected integrally with then spool valve 11 and shielded from the outside. However, a passage 40*a* for introducing ambient cold air is provided in the peripheral surface of the housing 40 and communicates with the clean ambient air produced by the air cleaner or the like.

The adjust amount actuating signal produced by the signal producing circuit 18 of the calculator 15 is, as mentioned before, applied to the coil 45. This actuating signal is a direct electric current. In the non-applied state thereof, the movable coil assembly 46 is in abutment with the body 30 and positioned as shown in FIG. 3 by the spring force of a compression spring 48 retained by the iron core 43.

When an electric current flows through the coil 45, the movable coil assembly 46 is drawn upward (in the drawing), and is lifted upward against the spring force of the spring 48. It is maintained at a balanced position corresponding to the valve of the electric current. A cooling air passage 43*b* which in addition serves as an air exhaust port extending from the guide hole 43*a* is formed in the iron core 43.

Next, the adjust sensor 14 is threadedly engaged at a threaded portion 50 with a large diameter portion of an axial hole of the sleeve 32. The sensor 14 comprises mechanical/electrical transducers such as a potentiometer, a differential transducer and the like well known in the art. A receiving arm 51 thereof is projected upward by a returning action and abuts against the lower end of the spool 33. As mentioned above, the electric output signal is fed back to the calculating device 15.

Each operation of the embodiment of the fuel supply device thus constructed will be described.

Figure 5:
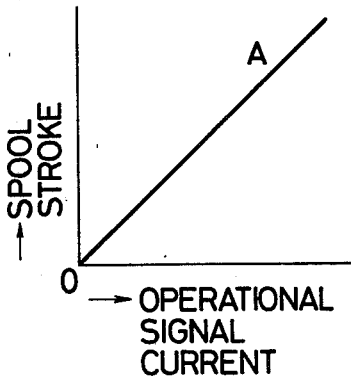
FIG. 5 is a graph showing driving characteristics of the motor.

(a) Driving Characteristics of Motor 13 (FIG. 5).

A stroke of an upward movement of the spool 33 is determined in response to the amount of the operational electric current flowing through the coil 45. Therefore, analogue characteristics becomes substantially linear, for example as a characteristic line A.

Figure 6:
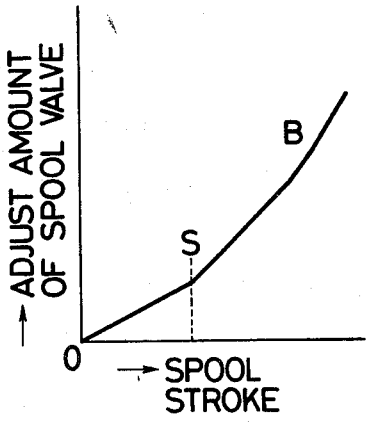
FIG. 6 is a graph showing adjust amount characteristics of the spool valve.

(b) Adjust Amount Characteristics of Spool valve 11 (FIG. 6).

When the spool stroke becomes zero, the fuel supply passage 33*a* is displaced to the adjust flow passage 32*d* as shown in FIG. 3. Accordingly, adjust amount is zero.

When the stroke is at zero to a minimum width end S of the adjust flow passage 33*a*, since the overlapped area between the fuel supply passage 33*a* and the adjust flow passage 32*d* gradually increases, the adjust flow amount increases in substantial linear relationship with a gentle slope rise as indicated by the characteristic line B. When the stroke is from the stroke S to the maximum stroke, the adjust flow passage 32*d* is spread in the form of a fan. During this range, the adjust flow amount increases with a substantial equal ratio.

Accordingly, the reduction of the accuracy of the adjust amount can be prevented in the low stroke region, that is, in a low load engine running condition.

(c) Driving Characteristics of the Adjust Amount.

Theoretical drive characteristics, that is, the mutual characteristics of the adjust flow amount with respect to the operational current flow by cooperation between the characteristics A and B.

(d) Operation of Calculating Circuit 17 of the Calculating Device.

(Data Storage)

Figure 7:
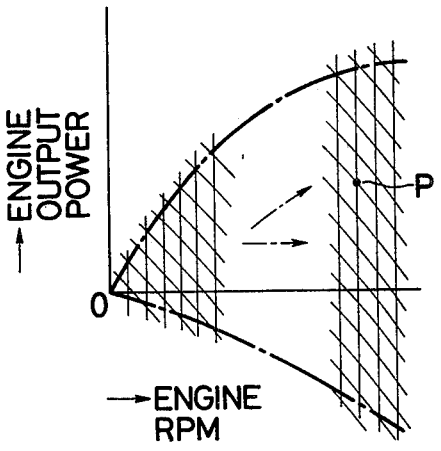
FIG. 7 is a graph showing operational points of the engine running conditions.

(1) The overall driving region of the engine output power curve diagram is equidistantly divided by sixteen equal engine rotational speed lines (indicated by longitudinal lines) and sixteen equal sucked air amount lines (indicated by oblique lines). 256 intersections defined by both lines are established as operational points P, which are committed to a memory portion of the calculating circuit. (FIG. 7)

(2) An optimum air/fuel ratio is determined on the basis of data from design and experiment with respect to each of the operational points P, which are memorized by the calculating device.

(3) Each oblique lattice defined by the adjacent four operational points is further divided by 16×16 lines, generating $256^2$ intersections which are established as sub-operational points. These are also memorized.

(Calculating Method)

(1) The closest sub-operational point to the combination between the input signal of the flow sensor 19 and the input signal of the rotational speed sensor 22 is determined.

(2) A required air/fuel ratio is calculated by distributing in proportion with n/16 (n is an integer) the memorized air/fuel ratio of the four operational points enclosing the sub-operational point.

(3) The calculated air/fuel ratio is modified by the sucked air amount (the sub-operational point) to thereby calculate the required adjusted flow amount which is transmitted to the servo signal generating circuit 18.

Next, the above-described adjust amount drive characteristic is predeterminedly memorized by the signal producing circuit 18. An electrical current amount in response to the adjust flow amount, received from the calculating circuit 17 is obtained in the circuit 18 which provides the motor 13 with the operational signal of the electric current amount.

A pulsation having a minute amplitude and a short period (about 200 Hz) is applied to the operational signal so that the spool 33 is vibrated minutely to thereby reduce the frictional force during the slide and movement thereof.

Further, in the signal generating circuit 18, when the stroke amount caused by the adjust amount sensor 14 is different from the stroke amount which is based on determining the electric current amount, the operational electric current amount is compensated for to increase or decrease until both stroke amounts coincide with each other.

In the calculating circuit 17, a true air/fuel ratio is counted back from the detected amount of the oxygen input from the exhaust gas component sensor 21, apart from the above-described calculating operation. When the count back valve is different from the calculated air/fuel ratio using the sub-operational points, to increase or decrease the air/fuel ratio by the difference, the compensation calculation is completed.

Also, part of the calculating device may be additionally used to control the operation devices other than the fuel feeding device, effectively and advantageously.

In the above embodiment, the adjust flow amount is varied by the configuration of the adjust flow passage 32*d*. Instead, the adjust flow passage of the sleeve 32 may be formed to have a constant surface and at the same time the diameter of the spool may be tapered so that the adjusted flow amount can be changed. Further, a needle valve may be used instead of the metering valve to obtain the same effect.

In the description concerning the operation, the detected value of the exhaust gas component is used for the adjust amount compensation. It is possible however to compensate for the adjust amount factor (mentioned above) in the same manner as mentioned above.

The embodiment of the fuel supply device thus constructed has the following excellent performance characteristics.

(a) The construction is simple since the injector 9 is installed at the congregated portion 8 of the intake manifolds.

(b) A stable air/fuel ratio is obtained since the air/fuel mixture is produced by the continuous injection of the injector 9.

(c) A function loaded on calculating means and an adjust amount construction are simplified in comparison with a conventional integral calculus control of intermitent flows since the control over the injection flow amount is carried out by the metering valve which is electromagnetically driven.

(d) Since the motor 13 is formed with the movable coil, the response thereof is excellent. Further, since the motor 13 and the adjust amount sensor 14 are separated from each other to thereby prevent the magnetic interference therebetween and the motor 13 and the metering valve 11 are cooled, a stable adjusted amount operation is completed.

(e) Since a suitable mixture for each of the engine running regions is obtained and in particular in an engine low load operation a stable combustion or explosion operation is completed, the engine running performance is enhanced.

What is claimed is:

1. In a fuel supplying device for an internal combustion engine comprising: a fuel supply passage for introducing fuel fed from a fuel pump at a substantially constant pressure to a fuel injector operative at a predetermined constant pressure, the improvement comprising: said fuel injector installed at a congregated portion of engine intake manifolds, a spool type metering valve including drive motor means receiving fuel from said fuel pump, a differential regulator receiving fuel from said fuel pump and said metering valve wherein a flow pressure drop to said fuel injector is maintained substantially constant by said differential regulator, said spool type metering valve being disposed in an intermediate portion of said fuel supply passage, calculating means including a servo signal generator for calculating an injection flow amount for a predetermined air/fuel ratio on the basis of signals of various engine running factors, said calculating means producing an operational signal output from said servo signal generating circuit to said drive motor means for driving said metering valve to thereby regulate fuel injected into the intake manifolds by said fuel injector, and a cooling air passage from the outside and a gas/liquid passage serving also as an exhaust passage for a leaking fuel are connected to each other between the drive motor means and the spool type metering valve and, an exhaust end of the gas/liquid passage is connected to a suitable portion of the intake system of the engine whereby cooling air and a fuel drain are absorbed at negative pressure.

2. A fuel supplying device for an internal combustion engine as claimed in claim 1, further comprising a flow sensor disposed in said intake manifolds wherein at least an electrical signal used for a sucked air flow value an output from said flow sensor disposed in the intake manifolds is employed as said operational signal.

3. A fuel supplying device for an internal combustion engine as claimed in claims 1 or 2, further comprising an exhaust gas component sensor generating an electrical signal for a specific component amount from an exhaust gas and disposed in exhaust gas passage of the engine is used as said operational signal.

4. A fuel supplying device for an internal combustion engine as claimed in claim 1, said operational signal is an electrical signal and a minute pulsation signal having a short period is added to an electrical output of the servo-signal whereby a frictional resistance generating by the operation of the metering valve is reduced.

5. A fuel supplying device for an internal combustion engine as claimed in claim 1, wherein said drive motor means comprises a fixed magnet and a movable coil slidably reciprocating by drawing and returning actions whereof while being tangent to an outside of said fixed magnet.

6. A fuel supplying device for an internal combustion engine as claimed in claim 5, further comprising an adjust amount sensor provided for detecting a stroke of said spool and for transducing said motion into an electrical signal and is fed back to the calculating means whereby controllability is imparted to the drive of the spool.

7. A fuel supplying device for an internal combustion engine as claimed in claim 6, wherein said drive motor means, said spool valve and said adjust amount sensor are coaxially disposed to form a integral construction.

8. A fuel supplying device for an internal combustion engine as claimed in claim 5, wherein a fuel supply passage is formed on a sliding wall of the spool and varies in width along the axis thereof whereby the adjust flow amount of the spool valve is adjusted in an analogue manner in response to the stroke of the spool.

9. A fuel supplying device for an internal combustion engine as claimed in claim 5, wherein a diameter of a groove in a cylindrical surface of the spool facing said fuel supply passage is tapered whereby the adjust flow amount of the spool valve is adjusted in analogue manner in response to the stroke of the spool.

10. A fuel supplying device for an internal combustion engine as claimed in claim 5, wherein a guide hole is formed in the fixed magnet, a longitudinal axial rod is projected from the movable coil, and the axial rod is inserted into the guide hole to thereby prevent the vibration of the movable coil around the axis.

* * * * *